United States Patent [19]

Caldwell

[11] 3,958,730

[45] May 25, 1976

[54] STOPPER PLUG FOR BOTTOM POUR LADLES

[76] Inventor: Robert A. Caldwell, 13593 Rose, Gibralter, Mich. 48173

[22] Filed: Sept. 13, 1974

[21] Appl. No.: 505,666

[52] U.S. Cl. ..... 222/559; 251/319

[51] Int. Cl.[2] ..... B22D 41/10

[58] Field of Search ..... 222/559, DIG. 3; 251/319

[56] References Cited

UNITED STATES PATENTS

| | | | |
|---|---|---|---|
| 280,618 | 7/1883 | Haws | 251/319 UX |
| 3,044,132 | 7/1962 | Murton | 251/319 |
| 3,415,427 | 12/1968 | Sharp | 222/559 X |

FOREIGN PATENTS OR APPLICATIONS

| | | | |
|---|---|---|---|
| 12,291 | 4/1905 | United Kingdom | 251/319 |

*Primary Examiner*—Robert B. Reeves
*Assistant Examiner*—David A. Scherbel
*Attorney, Agent, or Firm*—Irving M. Weiner; Pamela S. Burt

[57] ABSTRACT

A stopper plug apparatus for bottom pour ladles, fabricated from heat resistant ceramic and comprising a four-part stopper rod plug assembly which is joined together with refractory cement.

8 Claims, 7 Drawing Figures

FIG. 7
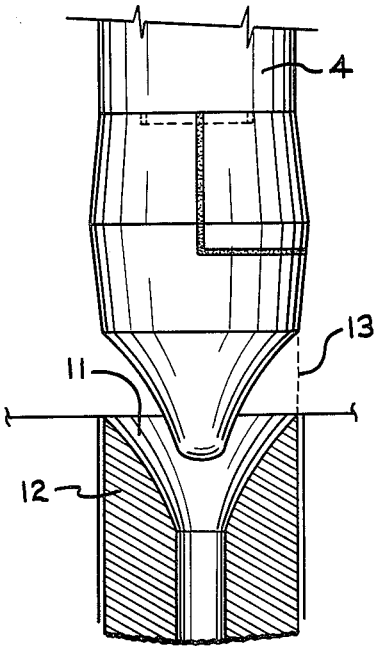
FIG. 3
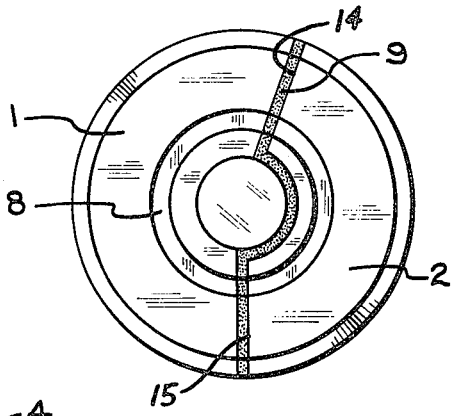
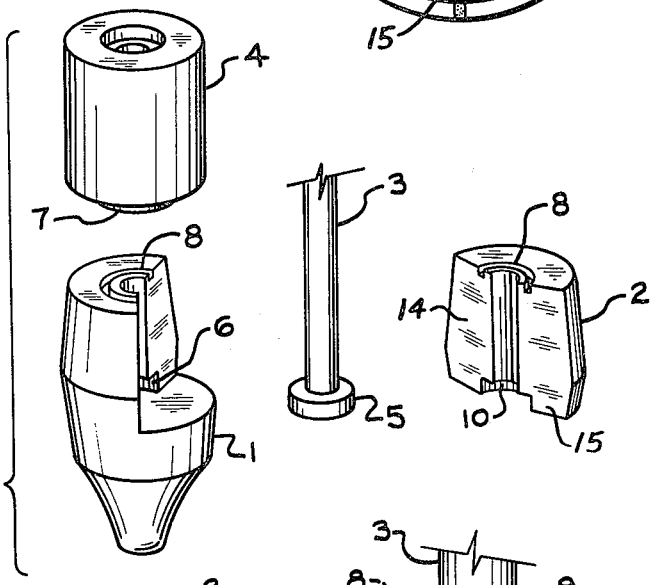
FIG. 1
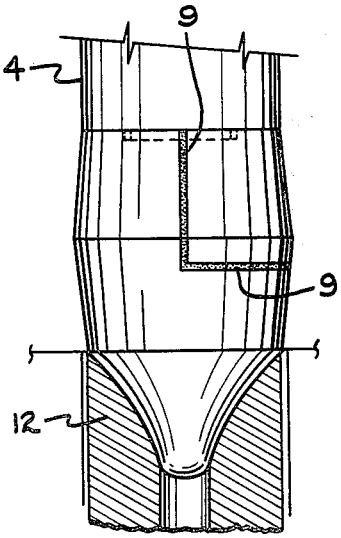
FIG. 6
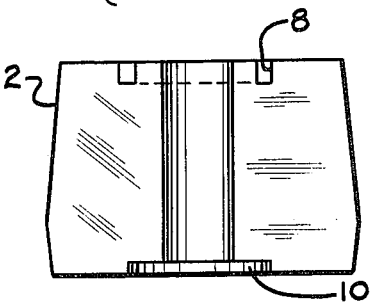
FIG. 4
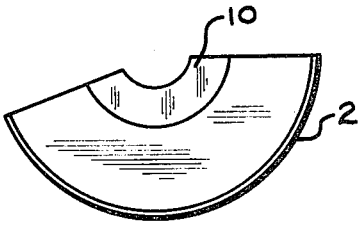
FIG. 5
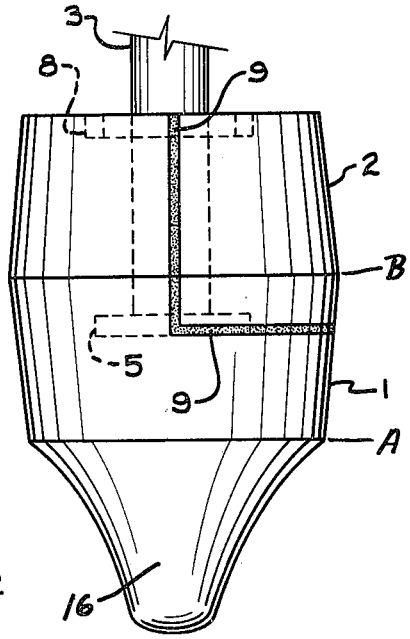
FIG. 2

STOPPER PLUG FOR BOTTOM POUR LADLES

The present invention relates to an apparatus for selectively opening and closing an aperture in the surface of a receptacle for flowable material. In particular, the present invention relates to a unique stopper plug-rod assembly for bottom pour ladles such as are now being used by the steel and other related industry.

BACKGROUND OF THE INVENTION

Bottom pour ladles used in pouring molten metals are customarily fabricated from or lined with refractory, i.e., nonfusible, material, capable of withstanding the enormous heats involved in molten metal processing.

Similarly, the stopper elements or plug which controls the flow of molten metal is also comprised of a non-fusible material. However, the stopper rod, generally mounted within the stopper plug, is metal and therefore subject to warpage, deflection and/or deterioration caused by the heat of the molten metal despite the protective sheathing of refractory material in which it is mounted. This stopper rod damage often leads to the misalignment of the stopper plug and, so, spillage.

The problems of stopper plug misalignment, stopper rod deterioration and of spillage have been dealt with through attempted improvements in the stopper plug and in the stopper plug and rod assembly which were designed to achieve better sheathing of the stopper rod by the plug. Examples of such prior art attempts are disclosed by U.S. Pat. No. 1,290,614 to McFarland; U.S. Pat. No. 2,195,791 to Slick; U.S. Pat. No. 3,103,720 to Roberts; and U.S. Pat. No. 3,044,132 to Murton.

There are, however, still disadvantages and drawbacks inherent in even the so-called improved embodiments of conventional stopper plug and stopper rod assemblies. Specifically, sectioned stopper plugs are susceptible to fracture during use and the stopper rods continue to be vulnerable to warpage and deterioration. Moreover, such prior art devices are, as a rule, not easily accessible for reworking. A further and serious drawback commonly experienced with conventional stopper plugs is the problem of spillage caused by stopper rod warpage and the misalignment of the stopper plug with the pouring nozzle.

The present invention serves to correct and ameliorate the difficulties experienced in existing stopper rod assemblies by providing a uniquely designed stopper head which will eliminate accidental spillage. Moreover, the novel stopper plug allows for positive on-off control and prevents the formation of skulls or pans.

A further advantage of the novel stopper plug is inherent in its construction, which provides a refractory cemented, bifurcated stopper head with a large sealing surface, resistant to fracture and allowing easy access to the stopper rod for reworking and strengthening when necessary.

SUMMARY OF THE INVENTION

The present invention provides an apparatus for selectively opening and closing an aperture in the surface of a receptacle for flowable material. The aperture includes first means for mating with the aperture and for selectively moving in a predetermined direction substantially perpendicular to a plane containing the line of intersection between the aperture and the surface of the receptacle to open and close the aperture.

The apparatus also includes second means for moving the first means and being detachably connectable to the first means. The second means is provided with projection means which is insertable into the first means in a direction substantially perpendicular to the predetermined direction so that at least a portion of the projection means is surrounded by the first means. The aparatus also includes third means, such as a locking key member, for mating with the first and second means and for surrounding a portion of the projection means. The first and second means completely surround the projection means, which may take the form of an annular cylindrical flange. The apparatus also includes fourth means, such as a refractory cement, for securing the third means to the first and second means. The first means, which may take the form of a stopper plug, is provided with fifth means, such as a concave conical portion, for permitting the flowable material to flow through the aperture in its opened condition while maintaining portions of the first means on both sides of the mentioned plane and for ensuring a positive return of the first means to a completely closed condition of the aperture even under conditions of warpage, deflection, erosion and/or misalignment of any of the first, second or third means to prevent undesirable flow of the flowable material and to prevent misalignment of the first means with respect to the aperture.

The present invention also provides a stopper plug and stopper rod assembly for use in bottom pour ladles, such as are commonly used for pouring molten metals. This unique stopper rod assembly comprises a bifurcated stopper heat which is adapted to matingly receive a flanged stopper rod. A locking key member, also conforming to the shape of the stopper rod fits onto the stopper plug and is cemented in place using a refractory cement. A stopper rod protector sleeve is then fitted over and is matingly received by the assembled stopper plug, completing the stopper plug assembly unit.

The bottom nose portion of the stopper plug assembly conforms to the shape of the pouring nozzle and in the closed position extends below the floor of the ladle, completely blocking the pouring nozzle. In its open position, the stopper plug is raised, however its bottom, nose portion is not allowed to rise above or clear the ladle floor. In this manner, warpage or deterioration of the stopper rod will result in merely the closure of the ladle; misalignment of the stopper plug and accidental spillage are thus completely averted.

Other advantages and objects of this invention will become clear upon reading of the following specification with reference to the accompanying drawings.

BRIEF DESCRIPTION OF THE DRAWINGS

FIG. 1 is an exploded perspective view of the novel unassembled stopper plug rod assembly.

FIG. 2 is a perspective view of the assembled stopper plug rod apparatus but without the refractory protector sleeve.

FIG. 3 is a top plan view of the FIG. 2 apparatus.

FIG. 4 is an elevational view of the inside wall structure of the locking key member;

FIG. 5 is a view of the bottom of the locking key member shown in FIG. 4.

FIG. 6 illustrates the fully-assembled apparatus in its closed position within the pouring nozzle.

FIG. 7 illustrates the apparatus of FIG. 6 in its open position with respect to the pouring nozzle.

DETAILED DESCRIPTION

As may be readily appreciated with reference to FIG. 1, the novel apparatus or stopper rod plug assembly comprises first means, such as a stopper plug 1, provided with a kerf 6 and adapted to matingly receive second means, such as a flanged stopper rod 3.

Third means, such as a locking key member 2, is also adapted to conform to the shape of the flanged stopper rod 3 and to fit upon the stopper plug 1. The locking key member 2 is secured into place on the stopper plug 1 with fourth means, such as a refractory cement 9, thus completing the stopper plug as seen in FIG. 2.

Sleeve means, such as stopper rod protector sleeve 4, is placed upon the completed stopper plug to protect the rod 3 and to furnish additional support to the stopper rod 3 and the other assembled components. The stopper rod protector sleeve 4 is provided at its bottom with an end extension 7 which is adapted to fit upon and mate with a complementary, recessed groove 8 provided on the top of the completed stopper plug, as best seen in FIGS. 1, 2, 3 and 4.

The stopper plug 1, as most clearly viewed in FIG. 2 comprises fifth means, such as a lower substantially conical portion or nose 16, and an upper, substantially cylindrical body. The lower portion of said upper body slopes inwardly approximately 6° from the vertical direction. This inward slope of the plug body serves to prevent the formation of skulls or pans, thus ensuring an even, uninterrupted flow of the molten metal.

The bottom or nose portion 16 of the novel stopper plug is adapted to fit upon and mate with the pouring nozzle 12 which rests directly below the ladle floor (FIG. 6).

In its closed position, as shown in FIG. 6, the stopper plug 1 rests in its mating position upon the pouring nozzle 12, thus completely blocking off said pouring nozzle 12 from the molten metal in the ladle, cutting off the flow. When desired, the stopper plug 1 may be lifted into an open position by means of the stopper rod 3 to allow the flow of molten metal to resume. However, in its open position, as seen in FIG. 7, at least a part of portion 16 of the stopper plug is at all times maintained below the ladle floor. In this way, the warpage, deflection or deterioration of the stopper rod cannot result in the misalignment of the stopper plug or in spillage. The stopper plug will always return to a completely closed posture with respect to the pouring nozzle, and thus will afford complete on and off control of the flow of molten metal from the ladle.

As can be seen from the foregoing description, the apparatus according to the present invention allows for a positive "on" and "off" control for the pouring of molten metals and other flowable materials. The novel apparatus will prevent accidental spillage due to stopper rod warpage and/or the misalignment of the stopper plug with respect to the pouring nozzle. Consequently, the present invention corrects a serious problem currently being experienced by the steel industry today.

FIG. 1 illustrates the unassembled components consisting of the stopper plug 1, the locking key member 2, the stopper rod 3 with its depending annular flange 5, and the stopper rod protector sleeve 4. In order to assemble these components into a single integral unit, the stopper rod 3 is moved laterally into the stopper plug 1 until the flange 5 is seated within the kerf 6 of the stopper plug 1. The locking key member 2, which is shaped to conform to the configuration of the stopper rod 3 and flange 5, is set in position on the stopper plug 1, and is held in place by the use of a refractory cement 9, which is shown in FIGS. 2, 3, 6 and 7. Placing the protective refractory sleeve 4 onto the stopper rod 3 with the end extension 7 dropping into the female recess 8 disposed on the top of plug 1 and locking key member 2 completely locks all the components together and solidifies the assembly.

FIG. 2 depicts the profile of the stopper rod plug assembly. The stopper rod 3 and the locking key member 2 are shown in locked position with the refractory cement 9. A female seating groove 8 will accept its male counterpart 7, which is the end extension of the stopper rod protector sleeve 4. It should be carefully noted that the plug 1 is provided with a lower portion 16 having a slightly concave conical generated shape which avoids misalignment problems and ensures a positive return of the plug within the nozzle 12.

With further reference to FIG. 2, it should be noted that a slope of approximately 6° from point "A" to point "B" on the outer wall of the stopper plug 1 prevents a skull or pan from forming at area 13 (see FIG. 7) when the stopper plug 1 is in the open or pour position. This allows for an interrupted flow of the material to the pouring nozzle 12 as shown in FIG. 7.

FIG. 3 is a top plan view of the structure shown in FIG. 2. The stopper plug 1 is mated with the locking key member 2, and is held together with the refractory cement 9. The female recess 8 accepts the sleeve extension 7, which is shown in FIG. 1. The locking key member 2 is provided with two side walls 14 and 15. With reference to FIG. 3, if side wall 15 is thought of as lying in a diametral plane, then the other side wall 14 will be seen to be formed at an angle of approximately 20° with respect to such diametral plane. In other words, one of the side walls 14 or 15 of the locking key member is cut at approximately 20° from a center line or a diametral plane which allows for a minimum opening required to insert the stopper rod 3 with its depending annular flange 5 during the assembly operation.

FIG. 4 illustrates the inside wall configuration of the locking key member 2. FIG. 5 illustrates a bottom view of the locking key member 2 showing the locking key kerf 10 which fits over the flange 5 on the stopper rod 3.

With reference to FIGS. 6 and 7, it is to be noted that FIG. 6 illustrates the apparatus of the present invention in a closed position with respect to the pouring nozzle 12. FIG. 7 depicts the apparatus according to the present invention in an open or pour position. It is significant to note that at no time is it necessary to completely lift or move the apparatus according to the present invention completely above the floor of the ladle during operation. It is also significant to note that the apparatus according to the present invention must always return to an absolute closed posture even if warpage and/or deflection of the stopper rod 3 occurs.

Furthermore, with reference to FIG. 7, it should be noted that the access pouring area 11 to the nozzle 12 remains unobstructed from any residual particles which might otherwise accumulate at area 13. This desirable condition is achieved by the approximately 6° slope from point "A" to point "B" on the outside wall of the plug 1 as shown in FIG. 2.

It is preferable to employ refractory materials for the various components of this invention, with the exception of the stopper rod 3, in order to resist conditions of extreme temperatures.

Although one preferred embodiment of the present invention has been particularly shown and described hereinabove, it should be understood that the invention is capable of various modifications, and that changes in the construction and arrangement of the various cooperating parts may be made without departing from the spirit or scope of the invention, as defined in the claims attached hereto.

I claim:

1. An apparatus for selectively opening and closing an aperture in a surface of a receptacle for flowable material, comprising, in combination:

first means for mating with said aperture and for selectively moving in a predetermined direction substantially perpendicular to a plane containing the line of intersection between said aperture and said surface of said receptacle to open and close said aperture;

second means for moving said first means and being detachably connectable to said first means;

said second means being provided with projection means which is insertable into said first means in a direction substantially perpendicular to said predetermined direction so that at least a portion of said projection means is surrounded by said first means;

third means for mating with said first and second means and for surrounding a portion of said projection means;

said first and third means completely surrounding said projection means;

fourth means for securing said third means to said first and second means;

said first means being provided with fifth means for permitting said flowable material to flow through said aperture in its opened condition while maintaining portions of said first means on both sides of said plane and for insuring a positive return of said first means to a completely closed condition of said aperture even under conditions of warpage, deflection, errosion and misalignment of any of said first, second and third means to prevent undesirable flow of said flowable material and to prevent misalignment of said first means with said aperture;

said second and third means including sidewalls which are disposed in planes that radiate from the longitudinal axis of said second means;

said fifth means including a plug surface having a slightly concave conical generated shape;

protective sleeve means disposed around the portions of said second means which project out of said first and third means;

said sleeve means being provided with an annular projecting extension;

said first and third means being provided with an annular concave seating groove into which said annular projecting extension fits to lock said first and third means together and to solidify said apparatus; and at least a portion of said first and third means is provided with a tapered outer surface which contacts said line of intersection between said aperture and said surface of said recpetacle when said apparatus is in said closed condition.

2. An apparatus for selectively opening and closing an aperture in a surface of a receptacle for flowable material, comprising, in combination:

first means for mating with said aperture and for selectively moving in a predetermined direction substantially perpendicular to a plane containing the line of intersection between said aperture and said surface of said receptacle to open and close said aperture;

second means for moving said first means and being detachably connectable to said first means;

said second means being provided with projection means which is insertable into said first means in a direction substantially perpendicular to said predetermined direction so that at least a portion of said projection means is surrounded by said first means;

third means for mating with said first and second means and for surrounding a portion of said projection means;

said first and second means completely surrounding said projection means;

fourth means for securing said third means to said first and second means;

said first means being provided with fifth means for permitting said flowable material to flow through said aperture in its open condition while maintaining portions of said first means on both sides of said plane and for ensuring a positive return of said first means to a completely closed condition of said aperture even under conditions of warpage, deflection, erosion and misalignment of any of said first, second and third means to prevent undesirable flow of said flowable material and to prevent misalignment of said first means with said aperture;

said second and third means include side walls which are disposed in planes that radiate from the longitudinal axis of said second means;

said fifth means includes a plug surface having a slightly concave conical generated shape;

protective sleeve means disposed around the portions of said second means which project out of said first and third means;

said sleeve means being provided with an annular projecting extension;

said first and third means being provided with an annular concave seating groove into which said annular projecting extension fits to lock said first and third means together and to solidify said apparatus;

at least a portion of said first and third means is provided with a tapered outer surface which contacts said line of intersection between said aperture and said surface of said receptacle when said apparatus is in said closed condition;

said receptacle comprises a bottom pour ladle;

said flowable material comprises molten metal;

said second means comprises a flanged stopper rod;

said first means comprises a stopper plug adapted to matingly receive said flanged stopper rod;

said third means comprises a locking key member conforming to the configuration of said flanged stopper rod and adapted to fit upon said stopper plug;

said aperture forms part of a pouring nozzle provided in the lower portion of said bottom pour ladle;

said fifth means comprises the bottom portion of said stopper plug, which bottom portion is a substantially conical portion adapted to fit upon and mate with said pouring nozzle provided in said bottom pour ladle; and said fourth means comprises refractory cement with which said locking key member is affixed to said stopper plug and to said flanged stopper rod.

3. An apparatus according to claim 2, wherein:

said projection means comprises a cylindrical flange; and said second means comprises a stopper rod consisting of an elongated steel rod having said cylindrical flange at one end thereof.

4. An apparatus according to claim 2, wherein:

said second means comprises a stopper rod; and there is further provided a stopper rod protector sleeve which further solidifies said apparatus.

5. An apparatus according to claim 4, wherein:

said first means comprises a stopper plug adapted to matingly receive said stopper rod;

said third means comprises a locking key member conforming to the configuration of said stopper rod and adapted to fit upon said stopper plug; and said stopper rod protector sleeve is provided with an extension adapted to fit upon and mate with a female recess counterpart on top of said stopper plug and said locking key member.

6. An apparatus according to claim 2, wherein:

said tapered outer surface of said stopper plug and of said locking key member slopes inwardly approximately 6° relative to said predetermined direction.

7. An apparatus according to claim 6, wherein:

said side walls of said locking key member are formed so that when one of said side walls of said locking key member lies in a diametral plane containing said longitudinal axis of said second means, the other side wall of said locking key member will lie in a radial plane disposed at an angle of approximately 20° from said diametral plane.

8. An apparatus according to claim 7, wherein:

said first, third, and fifth means and said protective sleeve means are fabricated from refractory materials which are resistant to conditions of extreme temperatures.

* * * * *